US006971372B2

(12) United States Patent
Ott et al.

(10) Patent No.: US 6,971,372 B2
(45) Date of Patent: Dec. 6, 2005

(54) METHOD AND DEVICE FOR DETECTING A PHASE OF A FOUR-STROKE GASOLINE ENGINE

(75) Inventors: Karl Ott, Markgroeningen (DE); Helmut Binder, Neckarsulm (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/501,281

(22) PCT Filed: Dec. 23, 2002

(86) PCT No.: PCT/DE02/04729

§ 371 (c)(1),
(2), (4) Date: Jan. 18, 2005

(87) PCT Pub. No.: WO03/060307

PCT Pub. Date: Jul. 24, 2003

(65) Prior Publication Data

US 2005/0126544 A1 Jun. 16, 2005

(30) Foreign Application Priority Data

Jan. 15, 2002 (DE) ..... 102 01 164

(51) Int. Cl.[7] ..... F02P 3/12; F02D 41/34
(52) U.S. Cl. ..... 123/491; 123/644; 123/179.5
(58) Field of Search ..... 123/491, 630, 123/643, 644, 179.5; 701/103, 113

(56) References Cited

U.S. PATENT DOCUMENTS 5,174,267 A 12/1992 DeBiasi ..... 123/643
5,370,099 A 12/1994 Koelle et al. ..... 123/643
6,029,631 A 2/2000 Jiewertz et al. ..... 123/491
6,453,733 B1 9/2002 Malaczynski et al. ..... 73/116
6,550,452 B2 * 4/2003 Schneider ..... 123/436

FOREIGN PATENT DOCUMENTS

| | | |
|---|---|---|
| DE | 44 18 578 | 11/1995 |
| DE | 196 81 614 | 10/1998 |
| DE | 198 17 447 | 10/1999 |
| EP | 0 979 941 | 2/2000 |
| JP | 54 065223 | 5/1979 |

OTHER PUBLICATIONS

Patent Abstracts of Japan, vol. 003, No. 088 (M-067), Jul. 27, 1979.

* cited by examiner

*Primary Examiner*—Hai Huynh
(74) *Attorney, Agent, or Firm*—Kenyon & Kenyon

(57) ABSTRACT

A method and a device for detecting the phase of a four-stroke gasoline engine, a gasoline direct injection engine in particular. For reliable phase detection involving relatively little expense during a starting phase, a crankshaft is turned together with at least one piston; ignition is triggered via an ignition coil in at least two successive top dead centers of the piston without a supply of fuel. A primary current or a secondary current, or a primary voltage or a secondary voltage are measured in a measuring period which extends at least over a spark duration after the ignition. From the comparison of the measuring signals of successive ignitions, a conclusion is drawn as to which of the successive top dead centers is an ignition top dead center and which is a charge cycle top dead center.

19 Claims, 2 Drawing Sheets

METHOD AND DEVICE FOR DETECTING A PHASE OF A FOUR-STROKE GASOLINE ENGINE

FIELD OF THE INVENTION

The present invention relates to a method and a device for detecting a phase of a four-stroke gasoline engine.

BACKGROUND INFORMATION

In engines whose fuel injectors are electronically controlled via an ECU (electronic control unit) it is necessary to determine the phase position at the start of the internal combustion engine. Since a combustion cycle extends over two 360° revolutions of the crankshaft, it is only determined via the phase position whether the piston is in the compression stroke or in the exhaust stroke during the upward motion.

Different systems are known in this connection. An additional transducer wheel may be provided on the camshaft or coasting detection may be performed. Such systems require additional expensive means.

Furthermore, in multipoint injection engines, the phase may be determined in what is known as a twin ignition system via fuel injection and ignition at the successive top dead centers.

Each second ignition finds an ignitable fuel mixture. Depending on the phase position, the injection takes place in the form of storage upstream from the closed intake valve or during the intake stroke with the intake valve open. However, unburnt air/fuel mixture is never pushed into the catalytic converter in engines having multipoint injection. After the engine is started, one may subsequently switch to single ignition in the I-TDC (ignition top dead center) using other TDC detection methods.

However, such a twin ignition system including ignition and injection in each crankshaft revolution may not be used in a gasoline direct injection (GDI) engine since, in these engines, injection must take place precisely during the intake stroke or at the beginning of the compression stroke, and injection during the exhaust stroke is not permitted, since otherwise unburnt fuel may be pushed out into the catalytic converter.

German Patent Application No. DE 198 17 447 describes a method and a device in which, during a starting phase, the crankshaft is turned by a starter and, for each crankshaft revolution, a voltage is applied to the spark plug at the approximate time of the appropriate top dead center without injection. Paschen's law, according to which the greater the pressure between the electrodes, the higher the ignition voltage, is used for detecting the phase. If the engine is turned by the starter, compression of the gas in the combustion chamber takes place only during the compression strokes, the highest pressure being reached at the ignition top dead centers (I-TDC) which are offset by a 720° crankshaft angle. A noticeably lower gas pressure is present in the charge cycle top dead centers (CC-TDC) between the exhaust stroke and the intake stroke, offset with respect to the I-TDCs by 360°. To differentiate the I-TDC from the CC-TDC, an ignition voltage is set which is only sufficient for ignition at the low pressure of the CC-TDC, but not at the high pressure of the I-TDC. For setting the ignition voltage, only an adequate ignition power is supplied to the ignition coil. An ion current analysis is performed to differentiate whether or not an ignition took place in the particular top dead center. If no ignition occurred, only a short half-wave, interrupted by the freewheeling diode, is measured in the primary circuit and the secondary circuit due to the component capacitances and the inductance of the particular ignition coil winding. However, an essentially triangular secondary current is measured as spark current in the event of an ignition.

The method and the device described in German Patent Application No. DE 198 17 447 may also be used in a GDI engine since ignition at the CC-TDC takes place without injection. A precise triggering of the ignition coil must initially take place in order to make the desired ignition power available. The required threshold value of the ignition power for differentiating the top dead centers may turn out to be different, in particular in different engines, so that a precise adjustment is difficult. Furthermore, analysis of the ion current measured for a precise differentiation between I-TDC and CC-TDC is relatively complex.

SUMMARY

A method and device according to an example embodiment of the present invention may have an advantage over the related art due to the facts that they may be achieved relatively inexpensively, they may make precise detection of the phase possible, and, in particular, they may also be used in a gasoline direct injection engine. Following phase detection, the engine may advantageously be started via correct injection and ignition according to the phase with the crankshaft already rotating.

Thus, according to the present invention and in contrast to the above-mentioned twin ignition systems, the engine is turned using ignition and without using injection. In contrast to German Patent Application No. DE 198 17 447, adequately high ignition power is supplied, resulting in an ignition at each crankshaft rotation without having to set a precise threshold value.

The example embodiment of the present invention is based upon the recognition that differentiation of the I-TDC from the CC-TDC is also possible when an ignition is executed in both top dead centers, since the ignition behavior is different in both positions. Due to the high pressure, the ignition voltage is high and the spark duration is short at I-TDC; whereas at CC-TDC the ignition voltage is low and the spark duration is long. The two positions may thus be differentiated after the occurrence of the ignitions by comparing the spark durations, the ignition current, or the ignition voltage applied to the spark plug.

According to one embodiment, the secondary current may be measured vis-à-vis ground, as a voltage drop for example, across a shunt resistor which is connected in series to the secondary winding of the ignition coil and the spark plug. In this case, the measuring device is formed in a simple manner by the shunt resistor in the secondary circuit. The voltage drop across the shunt resistor is picked up by an analyzing device in the form of a measuring signal.

A measurement in the primary circuit may be carried out in particular via the primary voltage which is tapped at the primary winding terminals of the ignition coil. In this case, a suitable measuring circuit having an operational amplifier or comparator may be used as a measuring device, and the primary voltage may be supplied, via a voltage divider circuit for example, to an input of the operational amplifier for comparison with a reference voltage at the other input of the operational amplifier. The operational amplifier in turn supplies a measuring signal to an analyzing device.

In both embodiments, the analyzing device may advantageously pick up the control signal of the ignition transistor in addition to the respective measuring signal in order to be able to determine the moment of ignition for the analysis of the measuring signal.

The analyzing device outputs a spark duration signal to a comparator which compares the spark duration signals with each other or with pre-stored values, thereby assigning a shorter spark duration to the ignition at I-TDC.

The phase detection method according to the present invention may be carried out on one piston or simultaneously on multiple pistons. After the phase detection is executed, the crankshaft rotation may be used for the starting operation by using correct injection and ignition according to the phase in the next I-TDC.

In contrast to phase detections via discharge detection or an additional transducer wheel on the camshaft, for example, no additional sensors, but rather only a simple circuitry, are thus required according to the present invention. This makes an engine start possible, even when the phase sensor is defective. The present invention may be used advantageously in gasoline direct injection engines in particular, since injection is completely avoided during phase detection and thus no fuel may reach the catalytic converter. Moreover, the present invention may also be used in multipoint injection engines; such a use is particularly advantageous in multipoint injection engines in which the conventionally used twin ignition system, i.e., ignition and injection at each top dead center, is problematic.

The measuring device and the analyzing device used according to the present invention may be integrated. In particular, no additional interference occurs in the primary and secondary circuits during a measurement of the primary voltage induced at the primary winding, so that reliable cost-effective phase detection is possible without further interference in the ignition operation.

BRIEF DESCRIPTION OF THE DRAWINGS

The present invention is explained in greater detail in the following based upon the Figures and several example embodiments described below.

DETAILED DESCRIPTION OF EXAMPLE EMBODIMENTS

Figure 1:
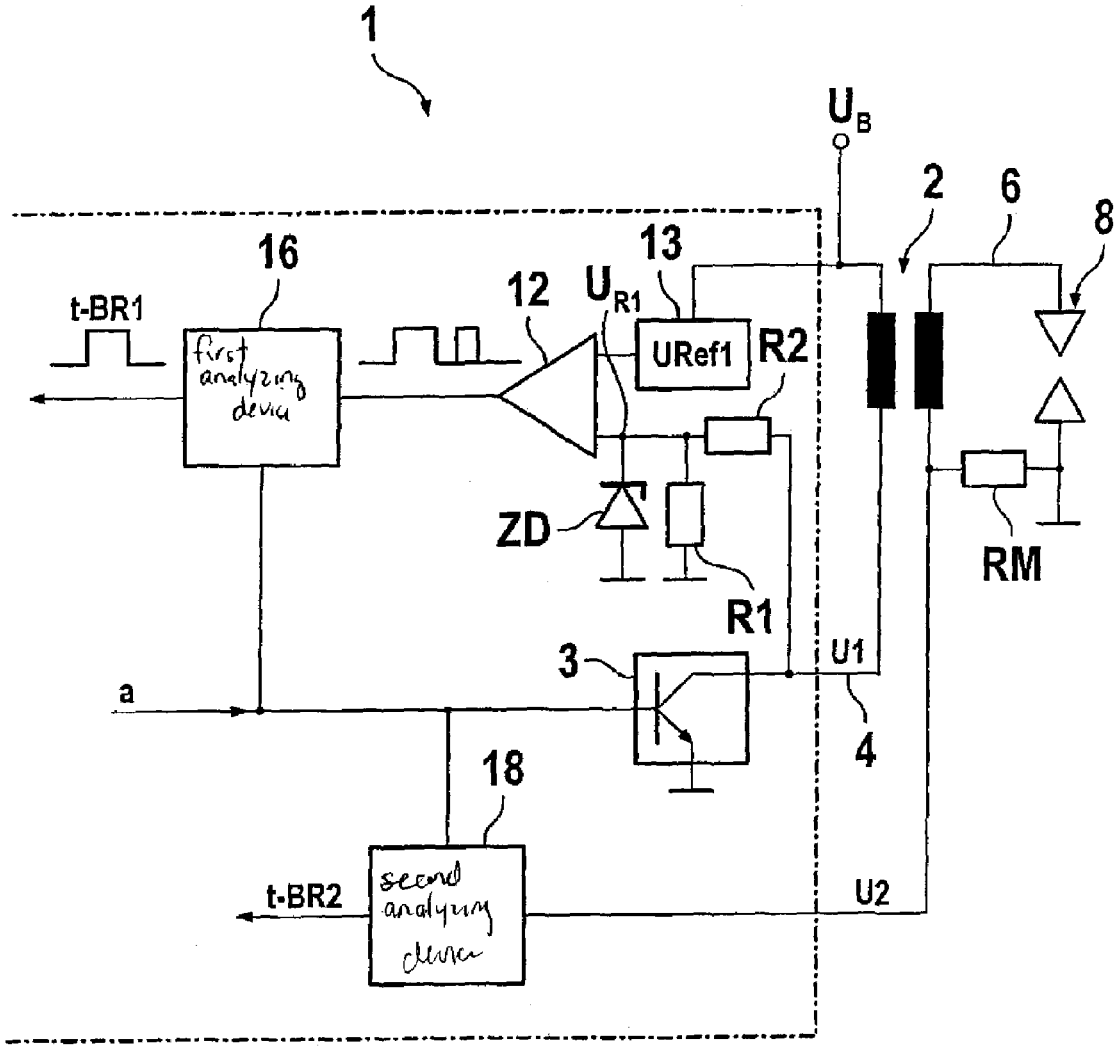
FIG. 1 shows a diagram of an ignition system including two alternatively usable devices for phase detection according to the present invention.

A primary winding of an ignition coil 2 and an ignition transistor 3 are situated in a primary circuit 4 between a battery connection of vehicle voltage UB and ground according to FIG. 1. Ignition transistor 3 is triggered by a control signal a and, in its low-resistance state, i.e., at high voltage level of control signal a, enables a primary current in primary circuit 4 via which a magnetic field is created in ignition coil 2. During subsequent blocking of ignition transistor 3 in its high-resistance state, i.e., at low voltage level of control signal a, the collapsing magnetic field of ignition coil 2 induces a voltage surge in its secondary winding, resulting in a spark discharge at a spark plug 8. At this juncture, according to the particular secondary current, a voltage U2 drops across shunt resistor RM, connected in series, vis-à-vis the grounded terminal of ignition coil 8.

According to an example embodiment of the present invention, the ignition system shown, including ignition coil 2, vehicle voltage UB, and control signal a, is selected in such a way that, prior to switching off the primary current, the ignition power stored in ignition coil 2 is sufficient for building up an adequately high ignition voltage at spark plug 8 for igniting a gas in the charge cycle top dead center (CC-TDC), as well as in the ignition top dead center (I-TDC).

Voltage U1, applied to the collector of ignition transistor 3 or to the corresponding terminal of the primary winding of ignition coil 2, is tapped by a voltage divider circuit having resistors R1, R2. One input of an operational amplifier 12 or comparator is connected to the voltage divider circuit between resistors R1 and R2, thus picking up a primary reference voltage $U_{R1}$=R1/(R1+R2)U1. Zener diode ZD which is shown may be connected parallel to R1 for voltage limitation. Resistors R1, R2 are selected in such a way that they do not greatly influence the primary current and that, in particular in the high-resistance state of ignition transistor 3, no noteworthy primary current, relevant for the magnetic field of ignition coil 2, flows through them. Due to the fact that, instead of U1, the primary reference voltage $U_{R1}$ is supplied to operational amplifier 12, a limited voltage value is applied at the moment of ignition, instead of the high voltage value of U1. R2=100 kOhm and R1=11 kOhm may be selected here, so that a current of approximately 2 mA flows through R2, and the operating voltage of U1 ranges between 20 V and 40 V and the operating voltage of $U_{R1}$ ranges between 2 V and 4 V.

The other input of operational amplifier 12 is connected to vehicle voltage $U_B$ via a second voltage divider circuit 13 or via another suitable device for setting a reference voltage URef. A reference voltage URef, dependent on vehicle voltage $U_B$, is generated by using voltage divider circuit 13, so that an advantageous automatic adaptation to changes in $U_B$ takes place (e.g., when the starter is operated). As a function of U1, operational amplifier 12 delivers a high or a low output signal. URef and R1, R2 are selected here in such a way that a primary voltage, induced by the secondary current during an ignition, may be detected and differentiated from an ignition current-free state. The output signal of operational amplifier 12 is supplied to a first analyzing device 16 which also picks up control signal a and outputs a spark duration signal t-BR1.

The spark duration signals output by first analyzing device 16 and second analyzing device 18 may subsequently be compared in a comparator (not shown) with signals of the measurement performed at the subsequent top dead center.

According to an example embodiment of the present invention, the first measuring device in the primary circuit or the second measuring device in the secondary circuit may be used alternatively; however, the use of both measuring devices and analyzing devices is also possible.

The same control signal a is output during ignition at the top dead centers offset by 360°, so that the same ignition power is supplied to the magnetic field of ignition coil 2. According to Paschen's law, however, a different ignition behavior occurs after ignition at I-TDC which has high-pressure compressed gas between the electrodes of spark plug 8 and the CC-TDC which has low-pressure gas between the electrodes of spark plug 8, resulting in varying voltage curves $U_{R1}$ and U2, as can be seen in FIGS. 2*a, b*.

During measuring and analyzing at primary circuit 4 of ignition coil 2, a low voltage value U1 and thus also $U_{R1}$ is initially present in both positions of the crankshaft prior to ignition, i.e., in the low-resistance state of ignition transistor 3. The subsequent ignition with an ignition voltage surge SP takes place at the charge cycle TDC at a lower ignition voltage, whereby voltage U1 in the primary circuit takes on a lower value and, according to the LW curve, $U_{R1}$ also takes on a lower value than at ignition TDC according to curve Z. The particular spark operation takes place with different spark durations t-BR-I-TDC and t-BR-CC-TDC. The particular measured voltage $U_{R1}$ is proportional to voltage U1 which is induced from the collapsing magnetic field of ignition coil 2. The magnetic field of ignition coil 2 having a larger secondary current in secondary circuit 6 collapses faster at ignition TDC, so that a larger voltage U1 having a shorter duration is induced in the primary circuit. The magnetic field of ignition coil 2 collapses more slowly with the formation of a smaller secondary current in the charge cycle TDC of the LW curve, so that voltage U1 induced in the primary circuit, and thus also $U_{R1}$, is smaller and has a longer spark duration t-BR-CC-TDC. A reference voltage URef1 is between the value of $U_{R1}$ during longer spark duration t-BR-CC-TDC and a static value $U_N$ after spark durations t-BR-I-TDC and t-BR-CC-TDC. The spark duration may thus be determined by comparing $U_{R1}$ with reference voltage URef1 in operational amplifier 12, the value of the output signal of operational amplifier 12 or comparator changing after the particular spark duration. This output signal of operational amplifier 12 is output to analyzing device 16 which picks up control signal a for determining the moment of ignition and outputs a spark duration signal t-BR1.

Figures 2A, 2B:
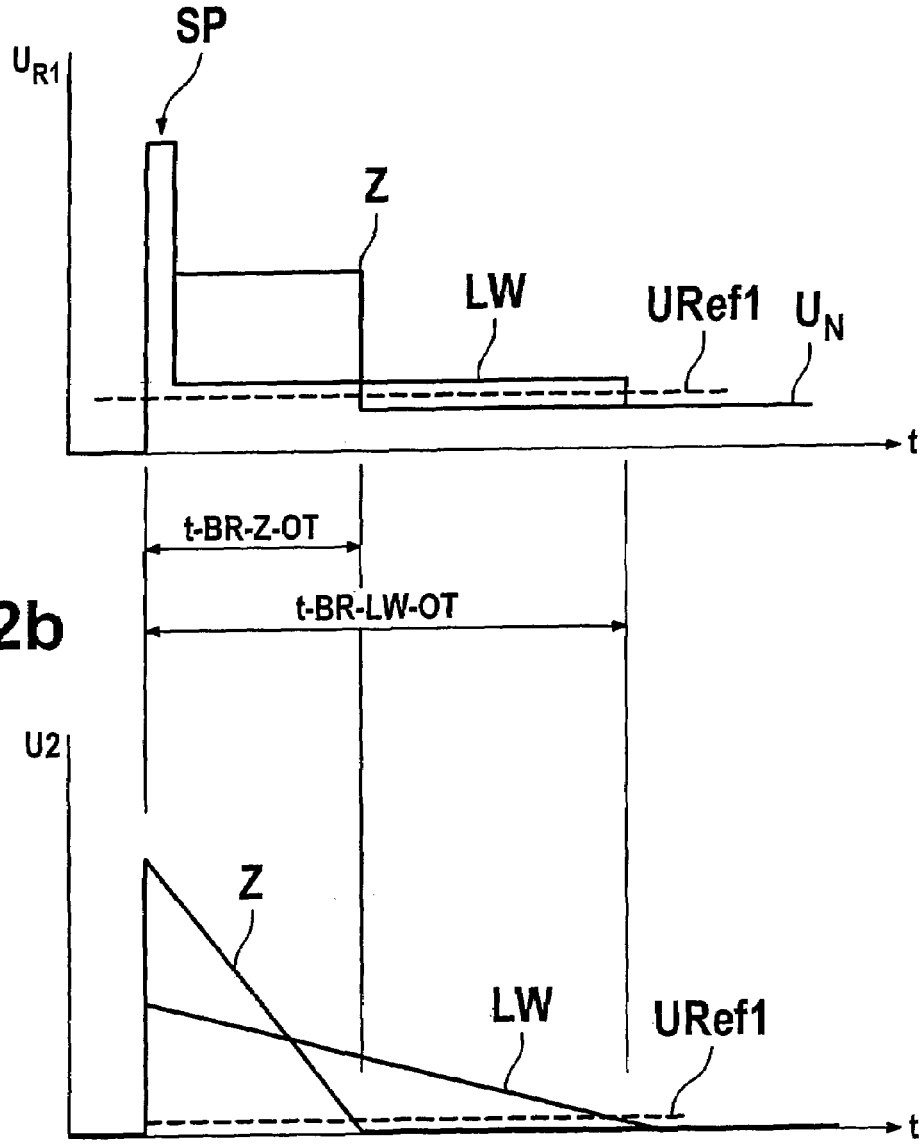
FIGS. 2*a, b* show diagrams of the variation over time of the voltages $U_{R1}$, U2 of FIG. 1 at the top dead centers.

If the second measuring device and second analyzing device are used alternatively, then according to the curve in FIG. 2*b*, a voltage U2, proportional to the induced secondary current, is picked up directly from second analyzing device 18. Measured curves Z of the ignition TDC and the charge cycle TDC shown in FIG. 2*b* are not necessarily strictly linear. The secondary current induced in the secondary winding of ignition coil 2 drops relatively quickly from a high initial value to zero within the spark duration t-BR-I-TDC. The secondary current induced during the charge cycle TDC drops from a smaller value to zero over the longer spark duration t-BR-CC-TDC. These measured curves may be differentiated, for example, by comparing voltages U2 shown with reference voltage URef2, depicted using a dashed line, in an operational amplifier or comparator of analyzing device 18, for example. URef2 is to be set adequately low in order to obtain a clear difference in the measured curves.

What is claimed is:

1. A method for detecting a phase of a four-stroke gasoline engine, comprising:

in a starting phase, turning a crankshaft together with at least one piston;

triggering an ignition via an ignition coil without supply of fuel at at least two successive top dead centers of the piston;

measuring one of: i) a primary current or a primary voltage of a primary circuit, or ii) a secondary current or a secondary voltage of a secondary circuit, in a measuring period which extends at least over a spark duration after the ignition;

comparing measurements of successive top dead centers; and determining, based on the comparison, which of the top dead centers is an ignition top dead center between a compression stroke and a power stroke, and which is a charge cycle top dead center between an exhaust stroke and an intake stroke.

2. The method as recited in claim 1, wherein the measurement identifying a shorter spark duration is assigned to the ignition top dead center.

3. The method as recited in claim 1, wherein the spark duration is identified as a time period after the ignition in which one of:

a primary voltage measured value or a secondary voltage measured value, or ii) a primary current measured value or a secondary current measured value exceeds a reference value.

4. The method as recited in claim 1, further comprising:

within the measuring period, comparing a primary voltage across a primary winding of the ignition coil or a primary reference voltage formed from the primary voltage via a voltage divider circuit with a first reference voltage; and outputting a spark duration signal as a function of the comparison.

5. The method as recited in claim 4, wherein a first reference voltage is between voltage values of the primary reference voltage during the spark duration of a charge cycle top dead center and a static voltage after the spark duration.

6. The method as recited in claim 1, wherein the secondary current is determined by measuring a secondary voltage drop across a shunt resistor which is connected in series to a secondary winding and a spark plug.

7. The method as recited in claim 6, further comprising:

comparing the secondary voltages measured at the top dead centers with a second reference voltage; and outputting a spark duration signal as a function of the comparison.

8. The method as recited in claim 1, further comprising:

outputting a spark duration signal as a function of the measurement and a control signal of an ignition transistor.

9. The method as recited in claim 1, further comprising:

determining the phase of a gasoline direct injection engine.

10. The method as recited in claim 1, further comprising:

determining the ignition top dead center in multiple cylinders.

11. A method for igniting a four-stroke gasoline direct injection engine comprising:

determining a phase of the engine and of a crankshaft rotation using a method including the following steps:

in a starting phase, turning a crankshaft together with at least one piston, triggering an ignition via an ignition coil without supply of fuel at at least two successive top dead centers of the piston, measuring one of: i) a primary current or a primary voltage of a primary circuit, or ii) a secondary current or a secondary voltage of a secondary circuit, in a measuring period which extends at least over a spark duration after the ignition, comparing measurements of successive top dead centers, and determining, based on the comparison, which of the top dead centers is an ignition top dead center between a compression stroke and a power stroke, and which is a charge cycle top dead center between an exhaust stroke and an intake stroke; and after determining the phase, injecting and igniting according to the phase without interruption of the crankshaft rotation.

12. A device for detecting a phase of a four-stroke gasoline engine, the engine including a primary circuit, a secondary circuit, an ignition coil, a spark plug, and an ignition transistor, the device comprising:

a measuring device configured to measure one of: i) primary voltage or a secondary voltage, or ii) a primary current or a secondary current, during a crankshaft rotation at times of successive top dead centers of a piston without a supply of fuel in a measuring period which extends at least over a spark duration after an ignition, and configured to output a measuring signal; and an analyzing device configured to pick up the measuring signal of the measuring device and output a signal which indicates which of the successive top dead centers is an ignition top dead center between a compression stroke and a power stroke and which is a charge cycle top dead center between an exhaust stroke and an intake stroke.

13. The device as recited in claim 12, wherein the measuring device is a primary voltage measuring device for measuring a primary voltage induced by the secondary current.

14. The device as recited in claim 12, wherein the measuring device has a comparator whose inputs are connected to primary winding terminals of the ignition coil via a voltage-setting device.

15. The device as recited in claim 14, wherein the comparator is an operation amplifier.

16. The device as recited in claim 14, wherein the voltage setting device includes a reference voltage circuit and a voltage divoder circuit.

17. The device as recited in claim 14, wherein the analyzing device picks up the measuring signal of the measuring device and a control signal of the ignition transistor and, as a function thereof, outputs a spark duration signal to the comparator.

18. The device as recited in claim 17, wherein the comparator has a memory element for intermediate storage of at least one spark duration signal of one measurement for comparison with the spark duration signal of a subsequent measurement.

19. The device as recited in claim 12, wherein the measuring device is a secondary current measuring device which has a resistor which, in a secondary circuit, is connected in series with a secondary winding of the ignition coil and the spark plug, the analyzing device picking up a secondary voltage drop across the resistor, as the measuring signal.

* * * * *